US009388027B2

(12) United States Patent
Seljestad

(10) Patent No.: US 9,388,027 B2
(45) Date of Patent: Jul. 12, 2016

(54) GUARD FOR MACHINE LINKAGE SYSTEM WITH TWO PADS

(71) Applicant: CATERPILLAR INC., Peoria, IL (US)

(72) Inventor: Gregory Allan Seljestad, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/522,486

(22) Filed: Oct. 23, 2014

(65) Prior Publication Data

US 2016/0115004 A1 Apr. 28, 2016

(51) Int. Cl.

*B66F 9/075* (2006.01)
*B66F 9/065* (2006.01)
*E02F 3/34* (2006.01)

(52) U.S. Cl.

CPC ..... *B66F 9/075* (2013.01); *B66F 9/065* (2013.01); *E02F 3/3411* (2013.01)

(58) Field of Classification Search

CPC ..... B66F 9/075; B66F 9/065; B66F 9/18; E02F 3/3411; B60P 1/50; B60P 1/04; B60P 1/6409; B60P 1/6481

See application file for complete search history.

(56) References Cited

U.S. PATENT DOCUMENTS 1,065,196 A * 6/1913 Windus ..... E02F 3/3411 254/131
2,926,799 A * 3/1960 Granryd ..... E02F 3/3411 414/719
2,959,306 A * 11/1960 Kampert ..... E02F 3/3411 414/713
3,200,978 A * 8/1965 Brady ..... B66F 9/18 414/606
3,389,820 A * 6/1968 Borer ..... E02F 3/3408 414/713
3,481,627 A * 12/1969 Felburn ..... B60P 7/12 410/50
T974,001 I4 9/1978 Neal
4,963,071 A * 10/1990 Larwin ..... E02F 3/3663 172/272
5,993,138 A * 11/1999 Anderson ..... B66F 9/065 414/697
5,993,139 A * 11/1999 Deneve ..... B66F 9/065 414/697
6,578,297 B1 * 6/2003 Forsberg ..... E02F 3/40 172/817
8,662,816 B2 * 3/2014 Grimes ..... E02F 3/3411 414/680
2006/0291987 A1 * 12/2006 Osanai ..... B66F 9/065 414/685
2012/0328400 A1 * 12/2012 Seljestad ..... E02F 3/404 414/724

FOREIGN PATENT DOCUMENTS

JP 2010121408 A * 6/2010

OTHER PUBLICATIONS

Photograph of lever guard taken Summer 2009.

* cited by examiner

*Primary Examiner* — Gerald McClain
(74) *Attorney, Agent, or Firm* — Finnegan, Henderson, Farabow, Garrett & Dunner, LLP

(57) ABSTRACT

A linkage arm for use with machine linkage systems is disclosed. The link may include a body having a first end opposite a second end with a first pin bore and a second pin bore disposed at the first and second ends respectively. The link may also include a front face and a rear face disposed on opposite sides of the body. The link may further include a guard connected to the front face. The guard may include a base plate, a first pad, and a first web connecting the first pad to the base plate. The first pad may form an upper leading surface oriented at about 25-35° relative to a virtual line drawn between centers of the first and second pin bores.

18 Claims, 3 Drawing Sheets

GUARD FOR MACHINE LINKAGE SYSTEM WITH TWO PADS

TECHNICAL FIELD

The present disclosure relates generally to a guard and, more particularly, to a guard associated with a linkage system of a mobile machine.

BACKGROUND

Machines, such as wheel loaders, have a linkage system that incorporates different types of attachments for performing different tasks. A common type of linkage system configuration is a Z-bar arrangement. Some Z-bar arrangements include a lift arm and at least one tilt arm connected to a tilt cylinder rod for rotating an attachment between a dump position and a rack position. For some Z-bar arrangements, a large object, such as a stone block, supported on the attachment, can make contact with the tilt arm and/or the tilt cylinder rod when the lift arm is low and the attachment is racked. Such contact may damage the object and could also damage the tilt arm or tilt cylinder rod. To prevent damaging contact, a guard may be attached to the tilt arm.

While known guards may protect linkage systems from some damage, they may not protect carried objects from damaging engagement with the guard. For example, a guard may prevent a large stone block from damaging the linkage system, but engagement of the guard with an edge of the block can unintentionally break pieces off the block. Further, blocks of various sizes may contact the linkage system at different places, thereby rendering conventional guards ineffective for multiple block sizes.

The disclosed guard is directed to overcoming one or more of the problems set forth above and/or other problems of the prior art.

SUMMARY

In one aspect, the present disclosure is directed to a linkage arm that may include a body having a first end opposite a second end. The linkage arm may also include a first pin bore and a second pin bore disposed at the first and second ends, respectively. A front face and a rear face may be disposed on opposite sides of the body, and a guard may be connected to the front face. The guard may include a base plate, a first pad, and a first web connecting the first pad to the base plate. The first pad may form an upper leading surface oriented at about 25-35° relative to a virtual line drawn between centers of the first and second pin bores.

In another aspect, the present disclosure is directed to a linkage system for a mobile machine. The linkage system may include a lift arm and a lift cylinder pivotally connected to the lift arm. The linkage system may also include a work tool pivotally connected to an end of the lift arm. The work tool may have a bottom surface configured to support material lifted by the linkage system, and a back surface oriented generally orthogonal to the bottom surface. The linkage system may further include a tilt arm pivotally connected to the lift arm and having a front face. A guard may be connected to the front face of the tilt arm. The guard may include a first pad that is generally coplanar with the back surface of the work tool when the work tool is racked to within about 5-10% of a full rack position.

In another aspect, the present disclosure is directed to a mobile machine. The mobile machine may include a frame, a power source mounted to the frame, and a linkage system pivotally connected to a front end of the frame and driven by the power source. The linkage system may include parallel lift arms having first ends connected to the frame, and second ends. The linkage system may further include lift cylinders connected to the frame and to the lift arms. The linkage system may include a work tool having a bottom surface configured to support material lifted by the linkage system, and a back surface oriented generally orthogonal to the bottom surface. The work tool may be pivotally connected to ends of the parallel lift arms. A tilt arm may be pivotally connected to the parallel lift arms and to the work tool. The tilt arm may have a front face. The linkage system may also include a tilt cylinder connected at a first end to the frame and at a second end to the tilt arm via a tilt rod. A guard may be connected to the front face of the tilt arm, and the guard may include a first pad that is generally coplanar with the back surface of the work tool when the work tool is racked to within about 5-10% of a full rack position.

DETAILED DESCRIPTION

Figure 1:
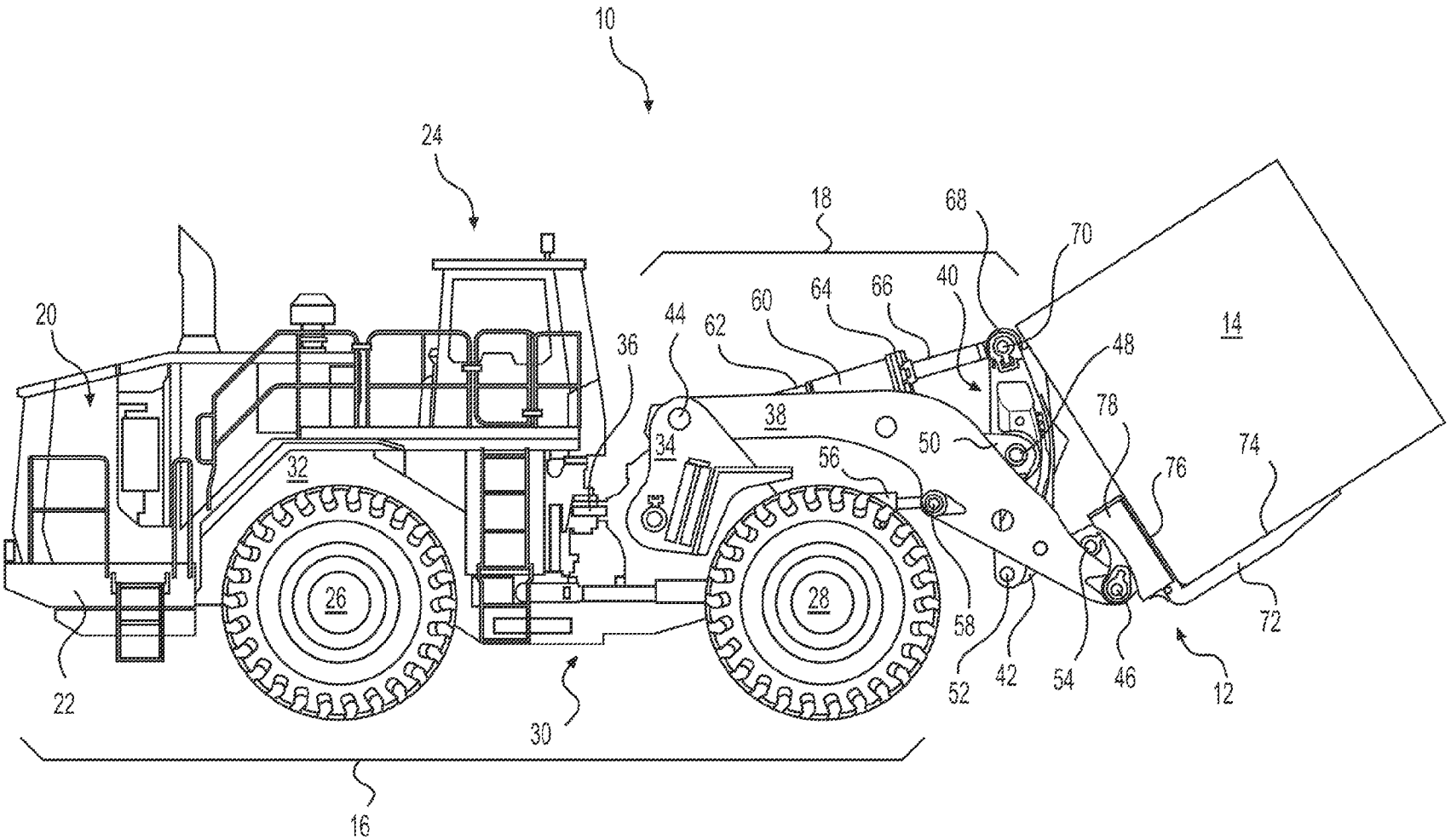
FIG. 1 is an isometric illustration of an exemplary disclosed mobile machine.

FIG. 1 illustrates an exemplary mobile machine 10. Machine 10, in the disclosed example, is a block-handling machine such as a wheel loader. Machine 10 may be configured to load a work tool 12 with a stone block 14 at a first location, transport block 14 from the first location to a second location, and unload block 14 from work tool 12 at the second location. It is contemplated, however, that machine 10 may embody another type of mobile machine, if desired, such as a track loader or similar machine in the art. It is also contemplated that machine 10 may be used for activities other than transporting blocks. Machine 10 may be a mobile machine having a tractor section 16, and a linkage system 18 connecting work tool 12 to tractor section 16.

Tractor section 16 in the disclosed embodiment is configured to support a power source 20, and includes a body 22, an operator station 24, a rear axle 26, and a front axle 28. Tractor section 16 may also include a frame assembly 30 having a rear frame 32 and a front frame 34. Frame assembly 30 in the disclosed example is an articulated frame configured to rotate on a hitch assembly 36. It is contemplated, however, that machine 10 may include different types of frames, such as a non-articulated frame. Power source 20 may be mounted on rear frame 32 and may be configured to supply electrical or hydraulic power to other parts of machine 10. Linkage system 18 may be pivotally connected to front frame 34 and operatively connected (e.g. via hydraulics) to power source 20. Operator station 24 may facilitate manual control of machine 10.

As shown in FIG. 1, linkage system 18 may include, among other things, a pair of spaced apart generally plate-like parallel lift arms 38 (only one is shown in FIG. 1), a tilt arm 40, and a tilt link 42. Lift arms 38 may be pivotally connected at a proximal end to front frame 34 via a pivot pin 44, and at a distal end to work tool 12 via an addition pivot pin 46. Tilt arm 40 may be generally centered between and centrally connected to lift arms 38 at a pivot pin 48, for example, via mounting lugs 50 that are integral with lift arms 38. Tilt link 42 may be connected between a distal end of tilt arm 40 and work tool 12 via pivot pins 52 and 54 respectively. A pair of substantially identical hydraulic lift cylinders 56 (only one shown in FIG. 1) may be connected at a first end to front frame 34 via a pivot pin (not shown in FIG. 1), and at an opposing second end to lift arms 38 via a pivot pin 58. A hydraulic tilt cylinder 60 may be located between lift arms 38, and connected at a head end 62 to front frame 34 via a pivot pin (not shown in FIG. 1). An opposing rod end 64 of tilt cylinder 60 may have a tilt rod 66 extending therefrom that is connected to tilt arm 40 via a rod eye 68 and a pivot pin 70. With this arrangement, extensions and retractions of lift cylinders 56 may function to raise and lower lift arms 38, respectively, along with connected work tool 12, tilt arm 40, and tilt link 42. Similarly, extension and retraction of tilt cylinder 60 may function to rack and dump work tool 12, respectively. This arrangement may be recognized as similar to the linkage of a Z-bar machine.

Work tool 12 is depicted in FIG. 1 as embodying a pair of forks 72, and may have a bottom surface 74 configured to support material lifted by linkage system 18, such as a stone block 14. Work tool 12 may also have a back surface 76 oriented generally orthogonal (e.g. within about 0-5°) to bottom surface 74, and a bracket 78 that connects work tool 12 to lift arms 38 and to tilt link 42 via pivot pins 46 and 54, respectively. With this arrangement, back surface 76 may be aligned with other components of linkage system 18 as work tool 12 is dumped or racked. It is contemplated, however, that work tool 12 may be another type of work tool, such as a bucket or other known type of work tool in the art.

Figure 2:
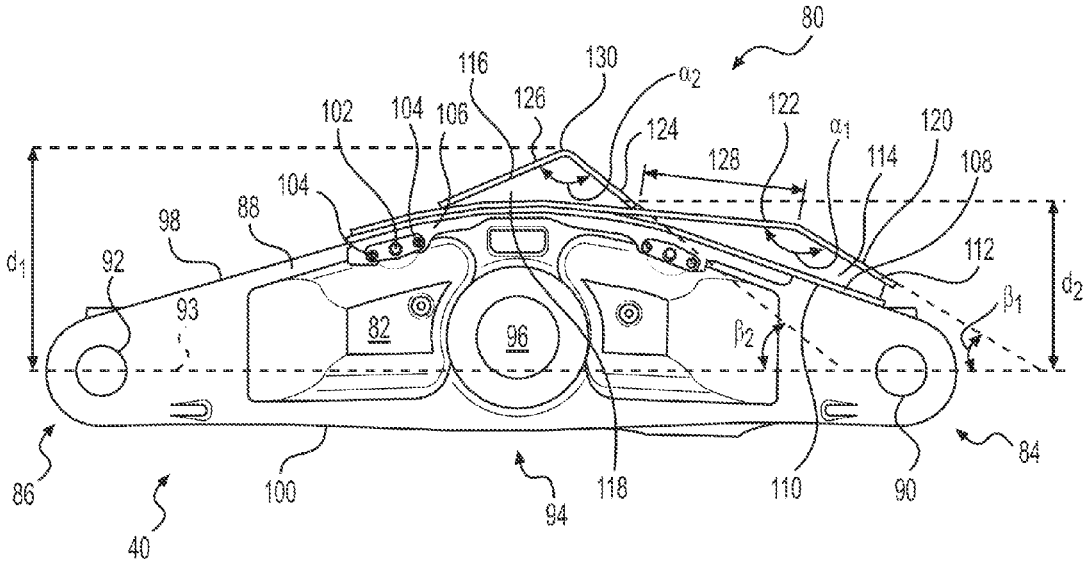
FIG. 2 is a front view illustration of an exemplary disclosed guard attached to an arm of a linkage system that may be used in conjunction with the mobile machine of FIG. 1.

FIG. 2 illustrates an exemplary tilt arm 40 equipped with a guard 80 that may be used in conjunction with linkage system 18. Tilt arm 40 may include a body 82 having a first end 84, a second end 86, and two lateral sides 88 (only one side seen in FIG. 2). First and second pin bores 90 and 92 (that receive pivot pins 70 and 52 respectively) may pass through both lateral sides 88 at first and second ends 84 and 86, respectively. Body 82 may also include a center section 94 between first and second ends 84 and 86, with a center bore 96 disposed therein. A virtual line 93 may pass through the centers of first and second pin bores 90 and 92. Center bore 96 may be configured to receive pivot pin 48, and pass through both lateral sides 88 at a position that is asymmetric between first and second pin bores 90 and 92. Tilt arm 40 may also include a curved front face 98 and a substantially flat rear face 100 disposed on opposite sides of body 82. Front face 98 may be curved such that front face 98 and rear face 100 are farthest apart in center section 94 and closest at first and second ends 84 and 86. Center bore 96 may be positioned between virtual line 93 and front face 98, and generally located where front face 98 and rear face 100 are farthest apart.

Guard 80 may be connected to front face 98 of tilt arm 40 between first and second ends 84 and 86 and provide one or more surfaces upon which objects carried by work tool 12 may rest. Guard 80 may be positioned asymmetrically between first and second ends 84 and 86, but may be generally closer to first end 84, as seen in FIG. 2. Guard 80 may generally conform to the curvature of front face 98 and may be connected thereto by any suitable means, such as by fasteners, by weld seams, or by any other suitable technique known to a person of ordinary skill in the art. In the example of FIG. 2, guard 80 is connected to front face 98 of tilt arm 40 by a plurality of bolts, such as large bolts 102 and small bolts 104. Large bolts 102 may be a first type of bolt having a first shear strength, and small bolts 104 may be a second type of bolt having a second shear strength. Large bolts 102 may have a higher shear strength than small bolts 104. For example, large bolts 102 may be suitable to alone support guard 80 and a carried object if small bolts 104 fail. Large bolts 102 may be anchored into lateral sides 88 and may be configured to support guard 80 on tilt arm 40. Small bolts 104 may also be anchored into lateral sides 88, and may be configured to secure guard 80 to tilt arm 40. A number of small bolts 104 may be utilized near each large bolt 102 to secure guard 80 against relative vibration. For instance, exemplary guard 80 in FIG. 2 includes two small bolts 104 near each large bolt 102. Under excessive shear force, such as that caused by side-to-side movements of objects carried by work tool 12, small bolts 104 may be intended to fail before large bolts 102, which may warn an operator that excessive or improper loading has occurred without resulting in a total failure of guard 80. An operator may then be able to safely unload work tool 12 and repair guard 80 before resuming operation of linkage system 18.

Guard 80 may include side plates 106 attached to opposite sides of body 82 by bolts 102 and 104. A pair of side plates 106 may be connected to and support a base plate 108 (only one side plate seen in FIG. 2). A bottom side 110 of base plate 108 may be connected to side plates 106 by weld seams or by any other suitable technique known in the art. Base plate 108 may be shaped to match the contour of front face 98. Guard 80 may also include a first pad 112 connected to and spaced apart from base plate 108, and a second pad 116 connected to first pad 112. A first web 114 may connect first pad 112 to base plate 108, and a second web 118 may connect second pad 116 to first pad 112. Side plates 106, base plate 108, first and second webs 114 and 118, and first and second pads 112 and 116 may be made of the same material and may be connected to each other by weld seams or another suitable method known in the art.

First pad 112 may include generally plate-like surfaces and form, for example, an upper leading surface 120 and an upper trailing surface 122, that are separated by a first pad angle $\alpha_1$. For example, first pad angle $\alpha_1$ may be about 150-160° (e.g. about 155°). Upper leading surface 120 may be oriented at an upper surface angle $\beta_1$ relative to virtual line 93 and may provide a substantially flat surface upon which a carried object may rest, thereby reducing contact between carried objects and body 82. For example, upper surface angle $\beta_1$ may be about 25-35° (e.g. about 30°) relative to virtual line 93. In this way, edge loading and chipping of a carried object may be reduced, and body 82 of tilt arm 40 may be protected from wear and damage. Upper leading surface 120 may be near first end 84 of body 82 (e.g. between center bore 96 and first end 84), which may also be an upper end of body 82 when tilt arm 40 is used in conjunction with linkage system 18. In this position, upper leading surface 120 may inhibit large objects carried by linkage system 18 from resting against first end 84 of body 82 or against rod eye 68 attached thereto.

Second pad 116 may be generally L-shaped and may extend over a portion of first pad 112. Second pad 116 may include generally plate-like surfaces and form, for example, a lower leading surface 124 and a lower trailing surface 126 separated by a second pad angle $\alpha_2$. For example, second pad angle $\alpha_2$ may be about 113-123° (e.g. about 118°). Lower leading surface 124 may be oriented at a lower surface angle $\beta_2$ relative to virtual line 93, which may be different than upper surface angle $\beta_1$. For example, lower surface angle $\beta_2$ may be about 35-45° (e.g. about 30°) relative to virtual line 93. In this configuration, edge loading and chipping of a carried object may be reduced, and body 82 of tilt arm 40 may be protected from wear and damage. Lower leading surface 124 may be generally located between upper leading surface 120 and second end 86 of body 82 (e.g. generally aligned with center bore 96), thereby defining a gap 128 between upper and lower leading surfaces 120 and 124. In this configuration, lower leading surface 124 may reduce edge loading and chipping of smaller objects that do not reach upper leading surface 120 of first pad 112.

Guard 80 may have a generally low profile, extending an overall first distance $d_1$ from virtual line 93 to a leading edge 130 of second pad 116. For example, first distance $d_1$ may be less than about 24 inches from virtual line 93. However, second pad 116 may extend a smaller second distance $d_2$ from front face 98 of tilt arm 40. For example, second distance $d_2$ from front face 98 to leading edge 130 may be within about 5-10 inches (e.g. 7.5 inches). By protruding a smaller distance from front face 98, second pad 116 may avoid contact with objects resting on first pad 112 and with other work tools that may be connected to linkage system 18 and moved to a racked position. It is contemplated that guard 80 may have other or additional pads to those described above, and that each pad may have multiple surfaces.

Figure 3:
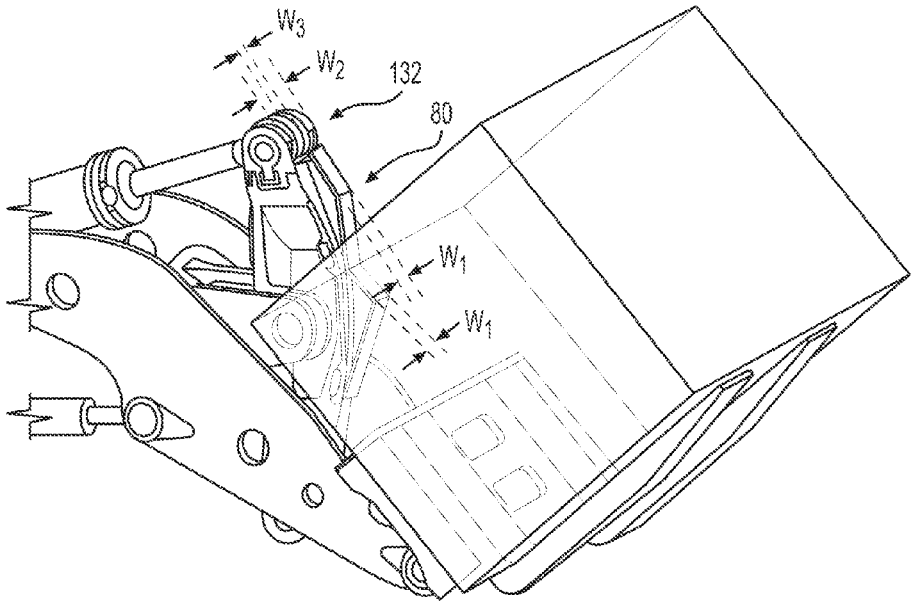
FIGS. 3-5 are perspective and isometric illustrations of the exemplary disclosed linkage system of FIG. 2 that may be used in conjunction with the machine of FIG. 1.

FIG. 3 shows a perspective illustration of exemplary tilt arm 40 and guard 80 in combination with the linkage system 18 of machine 10. As seen in FIG. 3, first pad 112 and second pad 116 may be of generally the same width $w_1$. FIG. 3 also shows that width $w_1$ of first pad 112 and second pad 116 may be less than a width $w_2$ of first end 84 of body 82. First end 84 may require the extra width to support a socket 132 that receives rod eye 68. Width $w_1$ of first and second pads 112 and 116 may also be less than a width of socket 132, which is substantially equal to a width $w_3$ of rod eye 68. By having a relatively narrow width, first and second pads 112 and 116 may experience less torque created by side-to-side movements of objects carried by linkage system 18 and resting against guard 80.

Figure 4:
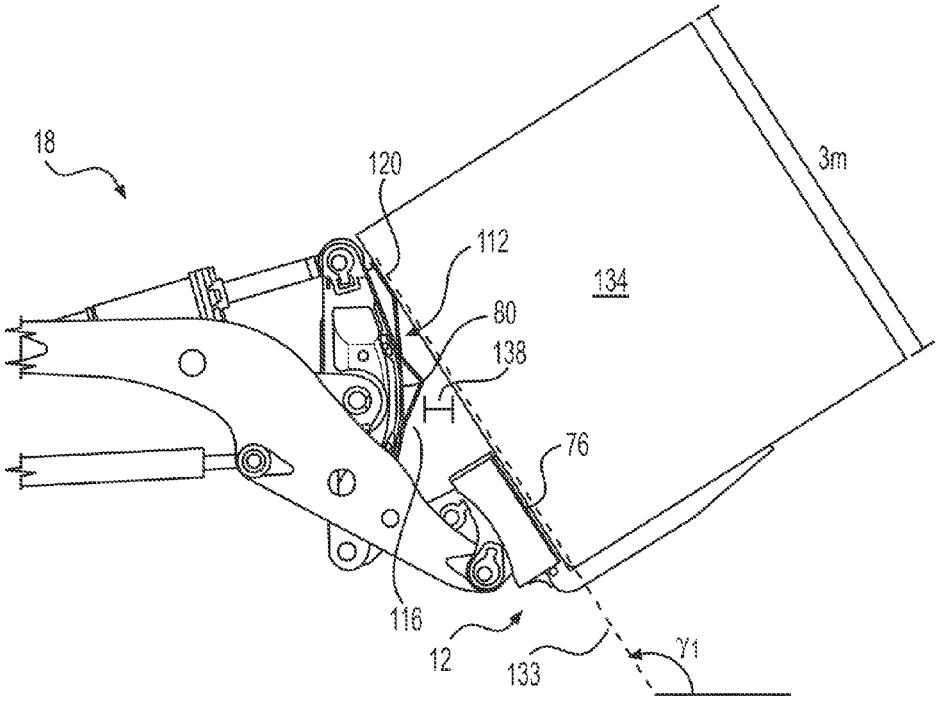
Figure 5:
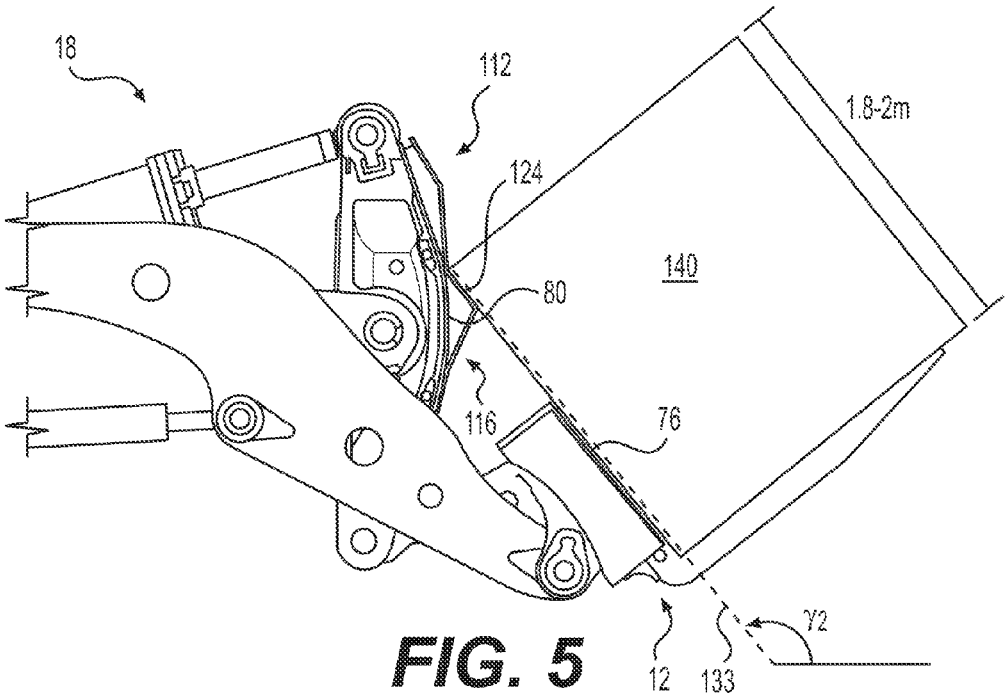

FIGS. 4 and 5 show linkage system 18 of FIG. 1 in a first exemplary orientation having a first rack position and in a second exemplary orientation having a second rack position, respectively. FIG. 4 shows linkage system 18 at a first rack position, wherein back surface 76 of work tool 12 is generally coplanar with upper leading surface 120 of first pad 112. Linkage system 18 may be in the first rack position when, for example, work tool 12 is tilted to a first tilt angle $\gamma_1$ that is about 121-124° with respect to the ground. In this position, work tool 12 may be racked to within about 25-30% of a full rack position. Linkage system 18 may also be in the first rack position when a carried object, such as a large stone block 134 having a height of about 3 meters or more is resting against back surface 76 of work tool 12 and upper leading surface 120 of first pad 112, thereby defining a virtual plane 133 that is shared by back surface 76 and upper leading surface 120. In this configuration, a clearance 138 exists between leading edge 130 of second pad 116 and large stone block 134 when work tool 12 is racked to within about 25-30% of a full rack position. This clearance may help to avoid damaging contact between large stone block 134 and second pad.

Similarly, FIG. 5 shows linkage system 18 at a second rack position, wherein back surface 76 of work tool 12 is generally coplanar with lower leading surface 124 of second pad 116. Linkage system 18 may be in the second rack position when, for example, work tool 12 is tilted to second tilt angle $\gamma_2$ of about 127-130° with respect to the ground. In this position, work tool 12 may be racked to within about 5-10% of a full rack position. Linkage system 18 may be in the second rack position when a carried object, such as a small stone block 140 having a height of about 1.8-2 meters, is resting against back surface 76 of work tool 12 and lower leading surface 124 of second pad 116. It is contemplated, however, that blocks of various other sizes may be supported by guard 80.

INDUSTRIAL APPLICABILITY

The disclosed guard may be applicable to mobile machines where large objects carried by an associated linkage system rest against links of the linkage system. The disclosed guard may reduce damage to carried objects and to the linkage system by providing flat surfaces in general alignment with carried objects of various sizes when a work tool of the linkage system is in a racked position. Operation of linkage system 18 incorporating guard 80 will now be discussed.

During operation of machine 10 (referring to FIG. 1), power source 20 may supply electrical or hydraulic power to other parts of machine 10, as guided by an operator in operator station 24 of machine 10. Power source 20 may supply linkage system 18 with hydraulic power to actuate lift arms 38 via hydraulic lift cylinders 56, thereby raising or lowering work tool 12 at a distal end of lift arms 38. Power source 20 may also supply hydraulic power to tilt cylinder 60 that may actuate tilt arm 40 to rack and dump work tool 12.

At a first location, an object, such as a large stone block 134 (referring to FIG. 4), may be loaded onto work tool 12 of machine 10 when lift arms 38 are low and work tool 12 is in a generally level or slightly dumped position. Large stone block 134 may be loaded onto work tool 12 such that it rests upon bottom surface 74 and against back surface 76 of work tool 12. Lift arms 38 may then be raised while work tool 12 is racked to within about 25-30% of a full rack position. At this point, large stone block 134 may become generally aligned with and rest upon first pad 112 of guard 80. First pad 112 may also become generally coplanar with back surface 76 of work tool 12 at this time. Machine 10 may then be moved to a second location where lift arms 38 may be lowered and work tool 12 dumped in order to leave large stone block 134 at the second location.

A small stone block 140 (referring to FIG. 5) may be loaded onto work tool 12 of machine 10 in a similar fashion when lift arms 38 are low and work tool 12 is in a generally level or slightly dumped position. Small stone block 140 may be loaded onto work tool 12 at a first location such that small stone block 140 rests upon bottom surface 74 and against back surface 76 of work tool 12. Lift arms 38 may then be raised while work tool is racked to within about 5-10% of a full rack position. At this point, small stone block 140 may become generally aligned with and rest upon second pad 116 of guard 80. Second pad 116 may also become generally coplanar with back surface 76 of work tool 12 at this time. Machine 10 may then be moved to a second location where lift arms 38 may be lowered and work tool 12 dumped in order to leave small stone block 140 at the second location.

Several advantages may be associated with the disclosed guard. For example, because guard 80 may include first pad 112 and second pad 116, carried objects may be prevented from contacting body 82 of tilt arm 40 and rod eye 68 attached thereto. In this way, damage to carried objects may be reduced while also reducing wear and damage to tilt arm 40 and rod eye 68. Additionally, because first and second pads 112 and 116 may respectively include upper and lower leading surfaces 120 and 124 separated by gap 128, guard 80 may accommodate objects of multiple sizes without causing damaging impact between the objects and guard 80.

It will be apparent to those skilled in the art that various modifications and variations can be made to the disclosed guard. Other embodiments will be apparent to those skilled in the art from consideration of the specification and practice of the disclosed guard. It is intended that the specification and examples be considered as exemplary only, with a true scope being indicated by the following claims and their equivalents.

What is claimed is:

1. A linkage arm, comprising:

a body having a first end opposite a second end;

a first pin bore and a second pin bore disposed at the first and second ends respectively;

a center bore positioned through the body and located between the first end and second end such that the first and second ends are pivotally connected about the center bore;

a front face and a rear face disposed on opposite sides of the body; and a guard connected to the front face and including:

a base plate;

a first pad; and a first web connecting the first pad to the base plate, wherein the first pad forms an upper leading surface oriented at about 25-35° relative to a virtual line drawn between centers of the first and second pin bores.

2. The linkage arm of claim 1, further including a pair of side plates, each of the pair of side plates being connected to the base plate and to an opposite side of the body.

3. The linkage arm of claim 2, wherein each of the pair of side plates are connected to the body with a first bolt having a first shear strength and a second bolt having a second shear strength.

4. The linkage arm of claim 1, wherein a width of the first pad is less than a width of the first end of the body.

5. The linkage arm of claim 1, wherein the upper leading surface of the first pad is located between the center bore and the first end of the body.

6. The linkage arm of claim 1, wherein the guard further includes:

a second pad; and a second web connecting the second pad to the first pad, wherein the second pad forms a lower leading surface oriented at about 35-45° relative to the virtual line.

7. The linkage arm of claim 6, wherein a leading edge of the lower leading surface extends less than about 24 inches from the virtual line.

8. The linkage arm of claim 7, wherein the leading edge extends about 5-10 inches from the front face of the body of the linkage arm.

9. The linkage arm of claim 8, wherein the upper leading surface is positioned between the first end of the body and the lower leading surface.

10. The linkage arm of claim 7, wherein the second pad extends over a portion of the first pad, forming a gap between the upper and lower leading surfaces.

11. A linkage system for a mobile machine comprising:

a lift arm;

a lift cylinder pivotally connected to the lift arm;

a work tool pivotally connected to an end of the lift arm, the work tool having:

a bottom surface configured to support material lifted by the linkage system; and a back surface oriented generally orthogonal to the bottom surface;

a tilt arm pivotally connected to the lift arm and having a front face;

a guard connected to the front face of the tilt arm and including a first pad that is generally coplanar with the back surface of the work tool when the work tool is racked to a first rack position;

wherein the guard further includes a second pad that is generally coplanar with the back surface of the work tool when the work tool is racked to a second rack position different than the first rack position.

12. The linkage system of claim 11, further including a tilt cylinder connected to an end of the tilt arm, wherein a width of the first pad of the guard is less than a width of a rod end of the tilt cylinder.

13. The linkage system of claim 11, wherein the guard further includes:

a base plate;

a pair of side plates connected to a bottom of the base plate; and a first web connecting the first pad to the base plate.

14. The linkage system of claim 13, wherein the guard is bolted to the tilt arm with a plurality of bolts, the plurality including a first bolt having a first shear strength and a second bolt having a second shear strength.

15. The linkage system of claim 13, further including a second web connecting the second pad to the first pad.

16. The linkage system of claim 15, a clearance exists between a leading edge of the second pad and an object carried by the linkage system when the work tool is racked to the second rack position.

17. The linkage system of claim 15 wherein a distance from the front face of the tilt arm to a leading edge of the second pad is within about 5-10 inches.

18. A mobile machine comprising:

a frame;

a power source mounted to the frame;

a linkage system pivotally connected to a front end of the frame and driven by the power source, the linkage system including:

parallel lift arms having first ends connected to the frame, and second ends;

lift cylinders connected to the frame and to the lift arms;

a work tool having a bottom surface configured to support material lifted by the linkage system and a back surface oriented generally orthogonal to the bottom surface, the work tool being pivotally connected to ends of the parallel lift arms;

a tilt arm pivotally connecting the parallel lift arms to the work tool and having front face;

a tilt cylinder connected at a first end to the frame and at a second end to the tilt arm via a tilt rod;

a guard connected to the front face of the tilt arm, the guard including a first pad that is generally coplanar with the back surface of the work tool when the work tool is racked to a first rack position;

wherein the guard further includes a second pad that is generally coplanar with the back surface of the work tool when the work tool is racked to a second rack position different than the first rack position.

* * * * *